US006540790B2

(12) United States Patent
Collins et al.

(10) Patent No.: US 6,540,790 B2
(45) **Date of Patent: *Apr. 1, 2003**

(54) TANNING LEATHER

(75) Inventors: Gareth Rhys Collins, West Midlands (GB); Christopher Raymond Jones, West Midlands (GB); Robert Eric Talbot, Staffordshire (GB); Jane Williams, Leicester (GB); Mohsen Zakikhani, Birmingham (GB)

(73) Assignee: Rhodia Consumer Specialties Limited, West Midlands (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/529,610

(22) PCT Filed: Oct. 28, 1998

(86) PCT No.: PCT/EP98/06837

§ 371 (c)(1),
(2), (4) Date: Apr. 14, 2000

(87) PCT Pub. No.: WO99/23261

PCT Pub. Date: May 14, 1999

(65) Prior Publication Data

US 2003/0000024 A1 Jan. 2, 2003

(30) Foreign Application Priority Data

Oct. 30, 1997 (GB) ..... 9722806
Sep. 18, 1998 (GB) ..... 9820254
Sep. 30, 1998 (GB) ..... 9821084

(51) Int. Cl.[7] ..... D01C 3/00; C14C 13/00; C14C 1/00

(52) U.S. Cl. ..... 8/94.1 R; 8/94.19 R; 8/94.11; 8/94.13; 8/94.15; 8/94.17; 8/94.18; 8/94.33; 106/15.15

(58) Field of Search ..... 8/94.1 R, 94.11, 8/94.13, 94.15, 94.17, 94.18, 94.19 R, 94.33; 106/15.05

(56) References Cited

U.S. PATENT DOCUMENTS

| | | | | |
|---|---|---|---|---|
| 2,732,278 A | | 1/1956 | Filachione | 8/94.33 |
| 3,104,151 A | | 9/1963 | Wallace et al. | 8/94.33 |
| 5,376,142 A | * | 12/1994 | Matthews et al. | 8/94.18 |

FOREIGN PATENT DOCUMENTS

| | | |
|---|---|---|
| EP | 0 808 908 | 11/1997 |
| GB | 2 287 953 | 10/1995 |
| GB | 2 314 342 | 12/1997 |

* cited by examiner

*Primary Examiner*—Yogendra N. Gupta
*Assistant Examiner*—Derrick G. Hamlin
(74) *Attorney, Agent, or Firm*—Frishauf, Holtz, Goodman & Chick, P.C.

(57) ABSTRACT

Leather is tanned by cross-linking collagen with tris (hydroxymethyl)phosphine or a condensate of a tetrakis (hydroxymethyl)phosphonium salt with an amide or amine in a main tannage or retannage.

22 Claims, No Drawings

TANNING LEATHER

The present invention relates to a novel process for tanning leather using phosphonium salts. Tanning is a process for the preservation of skins, by which is meant the collagen-containing integuments of vertebrates including mammals (e.g. cows, pigs, deer, goats, sheep, seals, antelope, mink, stoats and camels), fish, (e.g. sharks), reptiles (e.g. snakes, lizards and crocodiles), and birds (e.g. ostrich). Skins comprise a layer of collagen, and tanning entails reacting the collagen with a cross linking, or tanning, agent to cross link reactive sites within the collagen molecule. The product of the cross linking is leather, which is substantially less susceptible than skin to bacterial degradation.

A consequence of the cross linking is an increase in the minimum temperature at which the wet leather tends to shrink. This shrink temperature is often used as an indication of the degree of tanning.

The collagen layer of the skin is separated from fats, connective tissue and other subcutaneous protein, and optionally from the outer keratinous layer, by a combination of chemical and physical steps. The former may include liming, bating, pickling and/or degreasing.

The skin is then subjected to treatment in one or more stages with various tanning agents selected to give the desired end properties.

The main types of tannage are: vegetable tannage, based on tannin as the active cross linking agent; mineral tannage using various polyvalent metal salts, especially salts of chromium, aluminium, iron, or zirconium; and synthetic tanning agents, referred to as "syntans". Syntans include replacement syntans which are active tanning agents capable of tanning leather when used as the sole tannage and auxiliary syntans which are added to other tannages to modify the character of the leather but which are not in themselves active tanning agents. Syntans include various polymers and copolymers, such as those obtained by condensing formaldehyde with, for example, phenols and/or aryl sulphonates, and acrylate, methacrylate, acrylamide and/or acrylonitrile homopolymers and copolymers. Formaldehyde itself and dialdehydes such as glutaraldehyde are also used in tanning, usually in combination with other tannages.

For centuries the production of leather was based on the vegetable tannages which produce the characteristic brown colour traditionally associated with leather. One of the first mineral tannages was alum, but currently the most widely used tanning agent is chrome, usually in the form of basic chromium sulphate, which produces a blue grey leather with high shrink temperatures. However mineral tannages in general, and chrome tannages in particular are under pressure on environmental grounds. Syntans are less environmentally harmful than mineral tanning agents but typically give an off white or yellowish leather. Formaldehyde and difunctional aldehydes present a health hazard and are unpleasant to handle. Existing tanning processes cannot readily provide a good quality, pure white leather suitable for use as such or for dyeing, at least using environmentally acceptable and economically viable ingredients.

An object of the invention is to provide an environmentally acceptable tanning process which can produce white leather with high shrink temperatures e.g. above 80 and preferably above 85°. A further object is to produce a leather which is readily dyed, to give clear, light shades.

Tetrakis(hydroxymethyl)phosphonium salts which will be referred to generically herein as THP salts have long been used as fire-retardants for textiles and have been applied to the keratinous (fur) side of skins for this purpose. The salts may be applied directly to the fabric or in the form of precondensates which are water soluble or sparingly water soluble copolymers of THP with organic nitrogen compounds such as urea or an amine. Such copolymers are referred to herein as THP condensates. THP condensates may contain 2 or more phosphorus atoms, so long as the phosphorus compound is water soluble to a concentration of at least 0.5 g/l at 25° C. Such phosphorus compounds contain a total of at least 2 hydroxymethyl groups, usually at least one per phosphorus atom, and preferably at least 2 hydroxymethyl groups per phosphorus atom. The group or groups joining the phosphorus atoms together may be of the formula —R—, —R—O—, —R—O—R—, —R—NH—R or —R—R"—R— where R is an alkylene group of 1 to 4 carbon atoms and R" is the residue formed by removal of two hydrogen atoms, bonded to nitrogen, from a di or polyamide or an amine or di or polyamine, such as urea, a $C_{1-20}$ alkylamine, dicyandiamide, thiourea or guanidine. Such compounds with 2 or more, e.g. 3, hydroxyalkyl groups per phosphorus atom may be made by self condensation of THP salts with a compound of general formula $R''H_2$ such as urea, or a $C_{1\ to\ 20}$ alkylamine, e.g. by heating at 40 to 120° C. THP salts have also been known as possible ingredients of tanning liquors for more than thirty six years. U.S. Pat. No. 2,992,879 referred to THP chloride (THPC) as an unsatisfactory tanning agent on its own, and recommended a combination of THPC and a phenol such as resorcinol speculating that the two react together to form an effective tanning agent when the pH is raised. In fact THP salts do copolymerise with phenols such as resorcinol (see, for example, Textile Research Journal, December 1982, P743). U.S. Pat. No. 3,104,151 describes the use of such THPC phenol copolymers as light pretannages for leather in which the main tannage is vegetable or mineral. GB 2 287 953 describes the use of THP salts as cross linkers in conjunction with melamine formaldehyde or urea formaldehyde prepolymers, in order to form a copolymeric tanning agent in situ in the tanning liquor. EP 0 559 867 describes the use of THP sulphate (THPS) on raw or cured skin prior to tanning e.g. in acid degreasing. EP 0 681 030 describes the use of THPS as a cross for casein finishes applied to leather after tanning.

THP salts are stable under acidic conditions in the absence of air or oxidising agents. At pH above 3 and in the absence of oxidising agents they are gradually converted to the parent base, tris(hydroxymethyl)phosphine herein referred to as THP. Conversion is rapid and substantially complete between pH of about 4 and 6. Above pH 7, or in the presence of oxidising agents THP salts or THP are converted to tris(hydroxymethyl)phosphine oxide (THPO), conversion being rapid and substantially complete at pH above about 10, e.g. 12. It has been stated that THPO is an effective tanning agent.

We have now discovered that contrary to statements in the art, THPO is not an effective main tanning agent for leather, and that THP salts are also ineffective as main tannages. However we have found that THP and THP condensates are both highly effective main tanning agents. THP is most effective when formed in situ by first impregnating the leather with a THP salt, in the substantial absence of monomers or prepolymers which react or copolymerise with THP and raising the pH above 4 and preferably above 5. THP provides a particularly effective tanning system, which is ecologically friendly. We have found that THP gives leather which is especially suitable for dyeing. THP is especially effective in combination with syntans. In the absence of other tanning agents, especially vegetable tannages, mineral tannages, aldehydes and phenols the use of THP, alone or with syntans, and especially resin syntans, results in a particularly white leather.

The invention provides a method of tanning which comprises reacting collagen with THP or a THP condensate in a main tannage or retannage.

According to a preferred embodiment this invention provides a method of tanning in which skins which have been subjected to partial tanning in a pretanning operation are contacted with a THP salt in the substantial absence of a monomer or prepolymer capable of reacting or copolymerising therewith or of an oxidising agent capable of oxidising THP to THPO and at a pH below 4, and the pH is raised above 4, preferably above 4.5, more preferably above 5, most preferably above 5.5 e.g. 4 to 7 to form THP but not sufficiently to convert more than 20% of the weight of THP into THPO and for a sufficient time to raise the shrink temperature above 80° and preferably above 85°. According to a preferred embodiment the leather is subsequently retanned and dyed by contacting with a solution or dispersion of an appropriate dye.

According to a further embodiment our invention provides a method of tanning leather in which skins are contacted either simultaneously or consecutively, in one or more stages and in any order, with:

(A) THP in the substantial absence of a monomer or prepolymer capable of copolymerising therewith, and/or a THP condensate: and (B) a syntan, preferably a resin syntan.

In a preferred embodiment skins are tanned in a process involving an optional pretannage comprising THP, a THP condensate and/or a syntan, a main tannage in which the shrink temperature is raised above 80° C. and preferably above 85° C. and optionally a retannage wherein (A) THP and/or a THP condensate, and (B) a resin syntan are each used in at least one of the main tannage and the retannage.

For the purpose of this specification "syntan" is used to refer to synthetic organic compounds capable of reacting with collagen to form cross links or to modify the physical properties of the leather and also to auxiliary syntans which do not in themselves contribute substantially to the cross linking but which modify the physical properties of the leather. For example the term includes any water soluble polymer prepared by copolymerising formaldehyde, which is capable of increasing the shrink resistance of collagen and which comprises at least two units of the formula

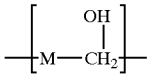

where each M is an aryl group such as a phenyl, naphthyl or aniline group substituted with one or more hydroxyl and/or sulphate, sulphone or sulphonimide groups or a urea or melamine residue. As used herein the term "syntan" also includes resin syntans which are homopolymers and copolymers of unsaturated carboxylic acids or their salts, esters, amides or nitrites, e.g. acrylic acid, methacrylic acid, acrylamide, acrylonitrile, maleic acid, fumaric acid, itaconic acid, aconitic acid, crotonic acid, isocrotonic acid, citraconic acid, mesaconic acid, angelic acid, tiglic acid and cinnamic acid. The copolymers may also comprise other vinylic comonomers such as styrene. Also included are acetone condensates with, for example sulphones and sulphonamides. Resin syntan may modify such properties as dye levelling, filling, grain appearance, break, grain strength, buffing nap, softness and tensile or tear strength.

THP may be formed in situ from any THP salt by raising the pH. It is preferred to use a catalyst for the formation of THP. For example a mixture of magnesium salt such as magnesium sulphate with a water soluble carboxylate salt such as sodium formate, sodium acetate, potassium propiate or other water soluble alkali metal or ammonium salt of a carboxylic acid, preferably the pH is raised above 3.5, more preferably above 4, e.g. above 4.5. High pH is preferably avoided because it converts THP to THPO, which is substantially ineffective as a tanning agent. We prefer that THP solutions for use according to our invention should have a pH less than 10, more preferably less than 9, especially less than 8, typically less than 7.5, most preferably 4.5 to 7. We prefer that the THP contains less than 15%, more preferably less than 10%, e.g. less than 9% of THPO based on the weight thereof. Generally the less THPO present the better.

The THP salt is preferably the sulphate (THPS), but may also be the chloride (THPC) or phosphate (THPP). Other salts which could less preferably be used include the bromide, sulphite, carbonate, acetate, citrate, formate lactate or borate. In principal, any water soluble THP salt with an anion which does not interact adversely with the leather may be used. It is preferred that oxidising agents for THP should be substantially absent.

The THP condensate may preferably be a condensate of a THP salt and urea or THP salt with an alkyl amine, e.g. a $C_{1-20}$ alkylamine. Alternatively the THP salt may be condensed with thiourea, guanidine, ammonia, dicyandiamide or with a combination of comonomers. The THP salt is usually THPC or THPS, although any salt of a counterion which does not react adversely with other components of the system may be used. The THP condensate may be formed in situ by adding THP or a THP salt and e.g. guanidine or dicyandiamide to the tannage.

The THP salt, THP and THP condensate is preferably used in a total concentration of from 0.01 to 20% by weight based on the total weight of the tanning liquor, more preferably 0.5 to 10%, e.g. 1 to 5%, most preferably 1.5 to 4%. The total proportion of the THP salt used is preferably from 0.3 to 20% by weight based on the weight of wet skin, more preferably 1 to 15%, especially 1.5 to 10%, most preferably 2 to 5%.

In the preferred embodiment, we prefer that the THP or THP condensate tanned leather, optionally after one or more other tanning stages, is contacted with an acid, basic or direct dye. It is observed that the rate of uptake of dye from the dyebath is substantially increased in leather which has been tanned using THP or THP condensate.

When the THP or THP condensate is used in combination with a syntan, the latter is preferably a polyacrylate, polymethacrylate, or copolymer of acrylic and/or methacrylic acid with acrylonitrile and/or acrylamide. Typically the polymer has a molecular weight in the range 1,000 to 200,000, more usually 3,000 to 100,000. Alternatively the syntan may be or may comprise a copolymer of formaldehyde with a hydroxy substituted and/or sulphonated benzene, alkyl benzene, naphthalene or alkyl naphthalene such as for example, phenol, benzene sulphonic acid, cresol, toluene sulphonic acid, xylenol; naphthalene sulphonic acid, resorcinol or phenol sulphonic acid, or mixtures, thereof in the form of random or block copolymers.

The syntan is preferably present at a concentration of from 0.5 to 35% by weight of the tanning liquor. e.g. 1 to 20%, more preferably 2 to 10% especially 3 to 6%. The total proportion of syntan used is preferably from 1 to 20% by weight based on the wet weight of skins, e.g. 2 to 10% especially 3 to 5%.

The proportion by weight of total THP, THP salt and THP condensate to syntan may typically be from 1:10 to 10:1, preferably 1:5 to 2:1, especially 1:2 to 1:1. The total proportion of tannages used is preferably from 2 to 20% active weight based on the wet weight of skins, e.g. 3 to 10%, especially 4 to 8%. The total tannage used preferably comprises more than 80% by weight, more preferably more than 90% by weight, e.g. more than 95% of total THP, THP salts, THP condensate and syntan. Where white leather is required, we prefer that the total tannages consist essentially of THP and/or THP condensate, and syntan. In particular we prefer the leather is not tanned with vegetable or mineral tannage, with aldehydes or with phenols.

The THP is applied in the substantial absence of monomers or prepolymers capable of copolymerising with THP such as phenol, urea, melamine or their precondensates with formaldehyde. For the purposes of this specification, "the substantial absence of monomers or prepolymers" means less than the minimum that would be capable of reacting or copolymerising with 50% of the THP, more preferably less than the minimum that would be required to react or copolymerise with 20%, e.g. less than 5% by weight based on the THP salt, most preferably less than 2%, especially less than 1%.

The THP or THP condensate is preferably applied as a first tanning step with a syntan as a retan. Preferably the THP is applied to acidified skins following aqueous degreasing. E.g. the initial pH is typically below 5, e.g. below 4. We prefer that the pH be raised above 5 and preferably maintained above 6 for the main duration of the tanning process.

The skins are preferably agitated in the tanning liquor for a sufficient time to raise the shrink temperature above 75° C., more preferably above 80° C., most preferably above 85° C.

The tanned skins are typically washed with warm water and fat liquored using a suitable oil or blend of oils. Fat liquoring is normally carried out after dyeing.

Penetration of the hide depends on the thickness of the hide and the pH at which the THP is applied. If the pH of the hide is too low when it is contacted with the THP inadequate take-up of the shrink inhibitor may occur. If the hide is too thick, penetration may be limited to the outer layers of the leather, leaving untreated areas in the interior. The extent to which THP has been absorbed by, and has penetrated, the hide needs to be determined.

THP users may also wish to be able to check effluents to ensure that THP has been removed or reduced to acceptable levels prior to discharge. Hitherto the only way of determining the presence of THP has been to take samples and to send them to an analytical laboratory for detailed analysis. This is a lengthy operation. Since many customers do not have suitably equipped laboratories the results may take days to obtain. Such methods are obviously unsuitable for routine quality control, and cannot provide the rapid feedback required for process control.

Unfortunately, we have found that THP does not readily give characteristic colour responses to any of the reagents most commonly used for the colorimetric analysis of organic bases.

We have now discovered that selenium provides a distinctive bright orange colouration with THP. The selenium is preferably added in the form of an aqueous solution of a colourless, water soluble, inorganic selenium compound and most preferably an oxyacid such selenic or preferable selenous acid or an oxysalt of selenium such as a selenate or preferably a selenite. The salt is preferably an alkali metal or ammonium salt, and most preferably sodium selenite. However, any colourless salt of selenous acid which is sufficiently soluble may be used.

Our invention therefore further provides a method of testing a leather to which THP has been applied as a main tannage or retannage or an effluent from such an operation in order to detect the presence of THP which comprises applying a colourless water, soluble inorganic selenium compound such as selenous acid or its salts thereto.

Preferably the concentration of selenium compound in the indicator solution is from 0.005 to 20% especially 0.01 to 10% more especially 0.05 to 5% e.g. 0.07 to 1%.

The indicator is preferably added to hides by steeping, injection, spraying, painting or, most conveniently, application with a dropper. The indicator is preferably used in proportion of from 0.001 to 0.05 g e.g. 0.005 to 0.01 g per $cm^2$ of surface.

In aqueous samples the indicator compound is preferably added in a concentration of from 10 to 10000 ppm based on the sample, e.g. 100 to 5000 ppm especially 500 to 2000 ppm.

The indicator solution is preferably aqueous and may have an acid, alkaline or neutral pH. For example the solution may be strongly acidified with mineral acid such as sulphuric, hydrochloric or nitric. One convenient form of indicator is an analytical standard comprising 1 gm per liter selenium as selenous acid in molar nitric acid.

Alternatively, the indicator may be a neutral or alkaline solution comprising a salt of selenous acid such as sodium selenite. In general the colour develops most strongly in samples having a pH greater than 3.

The dye is characterised spectrophotometrically by an absorption peak at 300 nm.

The invention is illustrated by the following examples in which all percentages are by weight based on the wet weight of skins unless stated to the contrary:

EXAMPLE 1

Degreased sheepskins were placed in a rotating drum with 80% water and 8% sodium chloride for 15 minutes. The pH was 3.4. To the drum was added 10% of a solution containing 25% by weight based on the weight of said solution of THPS. After 60 minutes the pH of the liquor was raised slowly to 6.5 and tanning continued for a further 2 hours. The shrink temperature of the partly tanned leather was measured at 86° C. 4% of a phenol formaldehyde polymer, for example products sold under the "ELTESOL" or "NEOSYN" CPP 48 Registered Trade Marks, which are a white, light-fast syntan was then added to the leather. After a further 60 minutes, the leather was washed with 200% warm (55° C.) water for 15 minutes and drained. The wash cycle was repeated.

The washed leather was fat liquored with a sulphated oil sold under the Registered Trade Mark "REMSYNOL" ESA and a sulphited fish oil under the Registered Trade Mark "REMSYNOL" ESI. The pH was adjusted to 3.6 with formic acid and the leather horsed until dry.

The leather was assessed as exceptionally full with a mellow handle, fully light-fast and with high tensile and tear strengths and high shrink temperature:

Tensile strength (1.4 mm) 180 Kg $cm^{-2}$ in perpendicular and parallel directions Banmann tear strength (1.4 mm) 12 Kg Final shrink temperature=92° C.

EXAMPLE 2

Degreased skins were subjected to the following sequences:

(i) 10 mins rotation at pH=5.2 with 5% magnesium sulphate and 2% sodium acetate and 100% water.

(ii) Addition of 1% of a 2:1 THPC/urea precondensate available from Albright & Wilson UK Limited under its registered Trade Mark "PROBAN" CC followed by 90 mins rotation at pH=4.5. The shrink temperature was elevated to 59° C. Testing a sample with selenium indicator gave a pale orange colour evenly distributed through the sample indicating even penetration.

(iii) The pH was raised to 5.8 by addition of 1% sodium carbonate and the shrink temperature rose to 71° C. The selenium indicator gave a bright orange colouration evenly distributed through the sample.

(iv) The pH was raised to 6.8 by addition of 0.75% sodium carbonate to give a shrink temperature of 84° C. The leather was tight with no visible case hardening.

No further elevation of shrinkage temperature could be obtained on addition of more carbonate.

EXAMPLE 3

THP condensate was used to enhance tanning by THP.

The process of Example 1 was repeated using 1% of a 75% aqueous solution of THPS in place of THP condensate in stage (ii) as a control. The maximum shrink temperature obtained was 80–81° C. The process was repeated, but using a mixture of 1% of a THP condensate comprising 3:1 THPC and urea reacted with a $C_{16-18}$ amine, and 1% of 75% THPS as the addition in stage (ii). The THP condensate is available from Albright & Wilson UK Limited under its registered Trade Mark "PROBAN" ST. The leather had a shrink temperature of 85° C. and a full, tight feel.

EXAMPLE 4

Example 1 was repeated using in step (ii) a mixture of 0.5% of the THP condensate of Example 1 and 0.5% of the THP condensate of Example 2. The shrink temperature was 74° C.

EXAMPLE 5

Following treatment with magnesium sulphate and sodium acetate as in stage (i) of Example 1, the skins were rotated for 2 hours with a mixture of 1% of the THP condensate of Example 1 and 1% of a 75% aqueous solution of THPS. The pH fell to 2.9, selenium indicator showed very pale yellow on flesh side only indicating poor penetration. Shrink temperature was 58° C. On basification with sodium carbonate to pH 6.5 the shrink temperature rose to 83° C. Selenium indicator gave an evenly distributed bright orange colour. The leather was of high quality, full and with a tight feel.

EXAMPLE 6

Example 4 was repeated replacing the THP condensate of Example 1 with that of Example 2. A similar product was obtained at pH 6.5 with a shrink temperature of 84° C.

EXAMPLE 7

Wet blue sheepskins were retanned as follows:

Wash
200% Water @ 35° C.
10'
Drain
Repeat
100 Water @ 35° C.
5% "ALBRITE" AD
45'
1.5% Ammonium Bicarbonate
0.5% Sodium Formate
40'
pH 5.6 (through cross section)
Wash
200% Water @ 50° C.
10'
Drain
Repeat
100% Water @ 50° C.
2% Dyestuff
40'
6% "REMSYNOL" ESA
4% "REMSYNOL" ESI
40'
Adjust pH to 3.4 with formic acid
Horse up
Dry and finish "ALBRITE" and "REMSYNOL" are registered trademarks "ALBRITE" AD is an aqueous solution of THP sulphate

EXAMPLE 8

Wet salted sheepskins were treated as follows:

All floats were approximately 500%:

1 st scour
Water @ 35° C.
1 g/l Wetting agent
0.5 g/l Sodium Carbonate
30'
Drain
Flesh
Water @ 35° C.
1 g/l Wetting agent
2 g/l Bating agent
0.5 g/l Sodium Metabisulphate
60'
Drain
Wash
Drain
Hydro
Shear wool to required length
Pickle
Water @ 20° C.
50 g/l Salt
10'
2.5 g/l Formic Acid
0.7 g/l Sulphuric Acid
120'
Leave overnight with intermittent running pH 2.8–3.0
Add 12 g/l "ALBRITE" AD
10'
4 g/l Sulphited oil (electrolyte stable)
360'
Leave overnight
Check shrinkage temp Basify to pH 6.5 with additions of sod carbonate
Check shrinkage temp
Drain
Rinse horse
Crust out
Butt and stake

EXAMPLE 9

Line split English 26K Ox hides were tanned as follows:
Wash
200% Water @ 30° C.
10'
Drain
Repeat
200% Water @ 35° C.
2% Ammonium Chloride
0.5% Sodium Metabisulphate
60'
pH 8.3 (through cross section)
1% "PANCREOL" PBW1 (Pancreatic bate)
45'
Drain
Wash
200% Water @ 20° C.
10'
Drain
Repeat
80% Water @ 20° C. Salt
8% Salt
10'
"PANCREOL" is a registered trademark
6°Bé
1.2% Sulphuric Acid
0.4% Formic
3 hours
6°Bé
2.8 pH
Add
10 "ALBRITE" AD
2 hours
Complete penetration
ADD
1.5% Sodium Carbonate
60'
1.5% Sodium Carbonate
60'
pH 6.8
Run for a further 3 hours
$T_s$°C. 89° C.
Horse up
Shave
Wash
200% Water @ 50° C.
10'
Drain
Repeat
100% Water @ 50° C.
5% "NEOSYN" AC4 (acrylic resin)
40'
2% Dyestuff
40'
"NEOSYN" is a registered trademark
6% "REMSYNOL" ESA
4% "REMSYNOL" ESI
40'
Adjust pH to 3.6 with formic acid

EXAMPLE 10

Leather was produced by the method Example 9 except that retannage and dyeing were as follows:
150% Water @ 45° C.
5% Mimosa
4% "NEOSYN" RW
45'
4% Dyestuff
45'
4% "REMSYNOL" ESA
4% "REMSYNOL"ESI
40'
Adjust pH to 3.4 with formic acid

EXAMPLE 11

English degreased pickled sheepskins were tanned as follows:
80% Water
8% Salt
15 minutes
pH 3.4
6°Bé
10% "ALBRITE" AD
60 minutes
Raise pH slowly to 6.5
120 minutes
Run 120 minutes @ 6.5
Shrinkage temperature 86° C.
Retan
ADD
4% "NEOSYN" CPP48 (white, light fast syntan)
60'
Wash
200% Water @ 55° C.
15'
Drain
Repeat
100% Water @ 55° C.
6% "REMSYNOL" ESI
4% "REMSYNOL" ESA
4% White Pigment
45'
Adjust pH to 3.6 with formic acid
Horse up overnight
Dry

EXAMPLE 12

English degreased pickled sheepskins were tanned as follows:
80% Water

8% Salt
15 minutes
pH 3.4
6°Bé
3.1 "ALBRITE AD75M"
60 minutes
Raise pH slowly to 6.5
120 minutes
Run 120 minutes @ 6.5
Shrinkage temperature 84° C.
Retan
"ALBRITE AD75M" is an aqueous solution of THP sulphate
ADD 4% "DEHSCOFIX" 914
Wash
200% Water @ 55° C.
15'
Drain
Repeat
100% Water @ 55° C.
5% "REMSYNOL" ESI
5% "REMSYNOL" ESA
45'
Adjust, pH to 3.4 with formic acid
Horse up overnight
Dry

EXAMPLE 13

English degreased pickled sheepskins were tanned as follows:

80% Water
8% Salt
15 minutes
pH 3.4
6°Bé
3% "ALBRITE AD75M"
60 minutes
Raise pH slowly to 6.5
Run 120 minutes @ 6.5
Shrinkage temperature 84° C.
Retan
ADD 4% "NEOSYN" DSF2
60'
Wash
200% Water @ 55° C.
Drain
"DEHSCOFIX" is a registered trademark
Repeat
100% Water @ 55° C.
5% "REMSYNOL" ESI
5% "REMSYNOL" ESA
45'
Adjust pH to 3.6 with formic acid
Horse up overnight
Dry

What is claimed is:

1. A method of tanning skins which comprises reacting collagen in the skins with tris(hydroxymethyl)phosphine formed by impregnating the collagen with an aqueous solution of a tetrakis(hydroxymethyl)phosphonium salt in the substantial absence of a monomer or prepolymer capable of reacting or copolymerising therewith, and raising the pH sufficiently to form tris(hydroxymethyl)phosphine but not a substantial proportion of tris(hydroxymethyl)phosphine oxide, and/or with a tetrakis(hydroxymethyl)phosphonium condensate in a main tannage or retannage.

2. A method of tanning skins according to claim 1 in which skins are impregnated with an aqueous solution of a tetrakis(hydroxymethyl)phosphonium salt and/or a tetrakis (hydroxymethyl)phosphonium condensate in the substantial absence of a monomer or prepolymer capable of reacting or copolymerising therewith or of an oxidising agent capable of oxidising tris(hydroxymethyl)phosphine to tris (hydroxymethyl)phosphine oxide and at a pH below 5, and the pH is raised sufficiently to form tris(hydroxymethyl) phosphine but not sufficiently to convert more than 20% of the weight of tris(hydroxymethyl)phosphine into tris (hydroxymethyl)phosphine oxide.

3. A method of tanning skins according to claim 1 in which skins are contacted either simultaneously or consecutively, in one or more stages and in any order, with:

(A) a tetrakis(hydroxymethyl)phosphonium salt in the substantial absence of a monomer or prepolymer capable of copolymerising therewith, and/or a tetrakis (hydroxymethyl)phosphonium condensate; and (B) a synthetic tanning agent.

4. A method of skin tanning according to claim 1, wherein skins are tanned in a process involving an optional pretannage comprising tris(hydroxymethyl)phosphine, a tetrakis (hydroxymethyl)phosphonium condensate and/or a synthetic tanning agent, a main tannage in which the shrink temperature is raised above 80° C. and preferably above 85° C. and optionally a retannage wherein (A) tris (hydroxymethyl)phosphine and/or a tetrakis (hydroxymethyl)phosphonium condensate, and (B) a resin synthetic tanning agent are each used in at least one of the main tannage and the retannage.

5. A method according to claim 1, wherein the leather is subsequently dyed by contacting with a solution or dispersion of an appropriate dye.

6. A method according to claim 5 wherein the leather is contacted with an acid, basic or direct dye.

7. A method according to claim 3, wherein the synthetic tanning agent is a resin synthetic tanning agent.

8. A method according to claim 2, wherein tannage comprises a catalyst for the formation of tris (hydroxymethyl)phosphine.

9. A method according to claim 4, wherein the tris (hydroxymethyl)phosphine and tetrakis(hydroxymethyl) phosphonium condensates are used in a total concentration based on the wet weight of the skins of from 0.3 to 20%.

10. A method according to claim 3, wherein a synthetic tanning agent is used in proportion of from 1 to 20% based on the wet weight of the skins.

11. A method according to claim 3, wherein the proportion by weight of tris(hydroxymethyl)phosphine to synthetic tanning agent is from 1:10 to 10:1.

12. A method according to claim 1, wherein the total proportion of tannage is from 2 to 20% active weight based on the wet weight of the skins.

13. A method according to claim 3, wherein the tris (hydroxymethyl)phosphine and/or tetrakis(hydroxymethyl) phosphonium condensate and synthetic tanning agent comprise more than 90% of the total active weight of tannage.

14. A method according to claim 1, wherein the main tannage consists essentially of tris(hydroxymethyl)

phosphine or a tetrakis(hydroxymethyl)phosphonium condensate and the retannage consists essentially of a synthetic tanning agent.

15. A method according to claim 1, wherein the penetration of tris(hydroxymethyl)phosphine into the hides is tested by applying to a sample a solution of selenous acid or a water soluble selenite.

16. A method of tanning skins according to claim 2 in which skins are contacted either simultaneously or consecutively, in one or more stages and in any order, with:

(A) tris(hydroxymethyl)phosphine in the substantial absence of a monomer or prepolymer capable of copolymerising therewith, and/or a tetrakis(hydroxymethyl) phosphonium condensate; and (B) a synthetic tanning agent.

17. A method according to claim 16, wherein the synthetic tanning agent is a resin synthetic tanning agent.

18. A method according to claim 5, wherein the proportion of total weight of tris(hydroxymethyl)phosphine and tetrakis(hydroxymethyl)phosphonium condensate to synthetic tanning agent is 1:10 to 10:1.

19. A method according to claim 18, wherein tannage comprises a catalyst for the formation of tris (hydroxymethyl)phosphine.

20. A method according to claim 4, wherein tannage comprises a catalyst for the formation of tris (hydroxymethyl)phosphine.

21. A method according to claim 11, wherein tannage comprises a catalyst for the formation of tris (hydroxymethyl)phosphine.

22. A method according to claim 13, wherein tannage comprises a catalyst for the formation of tris (hydroxymethyl)phosphine.

* * * * *